US009502835B2

(12) United States Patent
Chen

(10) Patent No.: US 9,502,835 B2
(45) Date of Patent: Nov. 22, 2016

(54) ELECTRICAL CONNECTOR HAVING A MOVABLE TERMINAL AND A STATIC TERMINAL

(71) Applicant: FOXCONN INTERCONNECT TECHNOLOGY LIMITED, Grand Cayman (KY)

(72) Inventor: Ming-Ching Chen, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/927,916

(22) Filed: Oct. 30, 2015

(65) Prior Publication Data

US 2016/0126646 A1 May 5, 2016

(30) Foreign Application Priority Data

Oct. 31, 2014 (TW) ..... 103137706 A

(51) Int. Cl.

| | |
|---|---|
| ***H01R 12/00*** | (2006.01) |
| ***H01R 24/46*** | (2011.01) |
| *H01R 103/00* | (2006.01) |
| *H01R 24/50* | (2011.01) |

(52) U.S. Cl.

CPC ..... *H01R 24/46* (2013.01); *H01R 24/50* (2013.01); *H01R 2103/00* (2013.01)

(58) Field of Classification Search

CPC .... H01R 9/05; H01R 13/658; H01R 13/648; H01R 13/42; H01R 13/436; H01R 24/46; H01R 24/50

USPC ..... 439/578, 63, 188; 200/51.1

See application file for complete search history.

(56) References Cited

U.S. PATENT DOCUMENTS

| | | | | |
|---|---|---|---|---|
| 6,554,630 | B2 | 4/2003 | Uratani | |
| 6,783,374 | B2 * | 8/2004 | Uratani | H01R 9/0515 439/188 |
| 7,331,805 | B1 * | 2/2008 | Hu | H01H 13/023 200/314 |
| 7,726,992 | B2 | 6/2010 | Wang et al. | |
| 7,976,315 | B2 | 7/2011 | Zuinen et al. | |

(Continued)

FOREIGN PATENT DOCUMENTS

| | | |
|---|---|---|
| TW | M361802 | 7/2009 |
| TW | M416899 | 11/2011 |

(Continued)

*Primary Examiner* — Chandrika Prasad

(74) *Attorney, Agent, or Firm* — Wei Te Chung; Ming Chieh Chang

(57) ABSTRACT

An electrical connector includes: an insulative housing including a first insulative base with a first contact-receiving slot and a second contact-receiving slot and a second insulative base mounted to the first insulative base; an insulative cap attached to the insulative housing; a metal shell covering the insulative housing and the insulative cap; a static terminal received in the first contact-receiving slot; and a movable terminal received in the second contact-receiving slot. The movable terminal includes a resisting portion connecting and a pair of extension arms extending from the resisting portion. The second contact-receiving slot includes an engaging groove and a holding groove crossing with the engaging groove, the engaging groove defines a bottom wall inclining upwardly from a middle thereof to outer ends thereof to support the free ends of the extension arms. And the resisting portion is operable to be in touch with the bottom wall.

17 Claims, 10 Drawing Sheets

(56) References Cited

U.S. PATENT DOCUMENTS

| | | | | |
|---|---|---|---|---|
| 8,066,516 | B2 * | 11/2011 | Hoshiba | H01R 24/44 439/63 |
| 8,113,857 | B1 * | 2/2012 | Huang | H01R 24/46 439/188 |
| 2011/0159708 | A1 | 6/2011 | Huang et al. | |
| 2014/0342604 | A1 | 11/2014 | Chen | |

FOREIGN PATENT DOCUMENTS

| | | |
|---|---|---|
| TW | M445288 | 1/2013 |
| TW | M468065 | 12/2013 |

* cited by examiner

ELECTRICAL CONNECTOR HAVING A MOVABLE TERMINAL AND A STATIC TERMINAL

BACKGROUND OF THE INVENTION

1. Field of the Invention

The present disclosure relates generally to an RF connector, and more particularly to an RF connector having a detection effect when a testing probe is inserted.

2. Description of Related Arts

U.S. Patent Application Publication No. 2011/0159708 discloses a coaxial connector including a metal shell, an upper insulative cover, an elastic terminal, a static terminal, and a lower insulative cover. The elastic terminal has a first fixed portion and a first contact sheet where two sides of the first contact sheet are respectively connected to an elastic sheet; the lowermost end of the elastic sheet has a bended section bent outward horizontally to contact with an upper end face of the lower insulating cover horizontally. The two elastic sheets are used to not only strengthen the spring force of the first contact sheet but also to prevent the first contact sheet from fatigue or losing spring force.

U.S. Pat. No. 6,554,630 discloses another conventional coaxial connector comprising an insulative base, a static terminal and a movable terminal both located in the insulative base, and a shielding shell. The movable terminal comprises a frame, a movable spring portion that is arranged such that both ends thereof are supported by the frame and a central portion thereof is movable and elastic, a contact portion that is integral with the movable spring portion and which comes into contact with and connects to a fixed terminal. The movable spring portion is formed by punching a stainless steel plate made of SUS301. Then, on surfaces of the stainless steel (SUS301), nickel plating films are formed and on the nickel plating films, gold is further plated so that the elastic movable portion has an overall thickness in the range from about 45 μm to about 62 μm.

An improved radio frequency connector is desired in the previous technology.

SUMMARY OF THE INVENTION

Accordingly, an object of the present invention is to provide a RF connector having an improved movable terminal to realize the miniaturization of the connector.

To achieve the above object, an electrical connector comprises: an insulative housing including a first insulative base and a second insulative base mounted to the first insulative base; an insulative cap attached to the insulative housing; a metal shell covering the insulative housing and the insulative cap; a static terminal affixed to the insulative housing and having a first contacting portion; and a movable terminal of a cantilever structure supported by the first insulative base, the movable terminal including a second contacting portion contactable with the first contacting portion, a second fixed portion extending from the second contacting portion, a resisting portion connecting with the second contacting portion, and a pair of extension arms extending from the resisting portion; wherein the first insulative base defines a first contact-receiving slot receiving the static terminal and a second contact-receiving slot receiving the movable terminal, the second contact-receiving slot includes an engaging groove and a holding groove crossing with the engaging groove, the engaging groove defines a bottom wall inclining upwardly from a middle thereof to outer ends thereof to support the free ends of the extension arms, and the resisting portion is operable to be in touch with the bottom wall.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
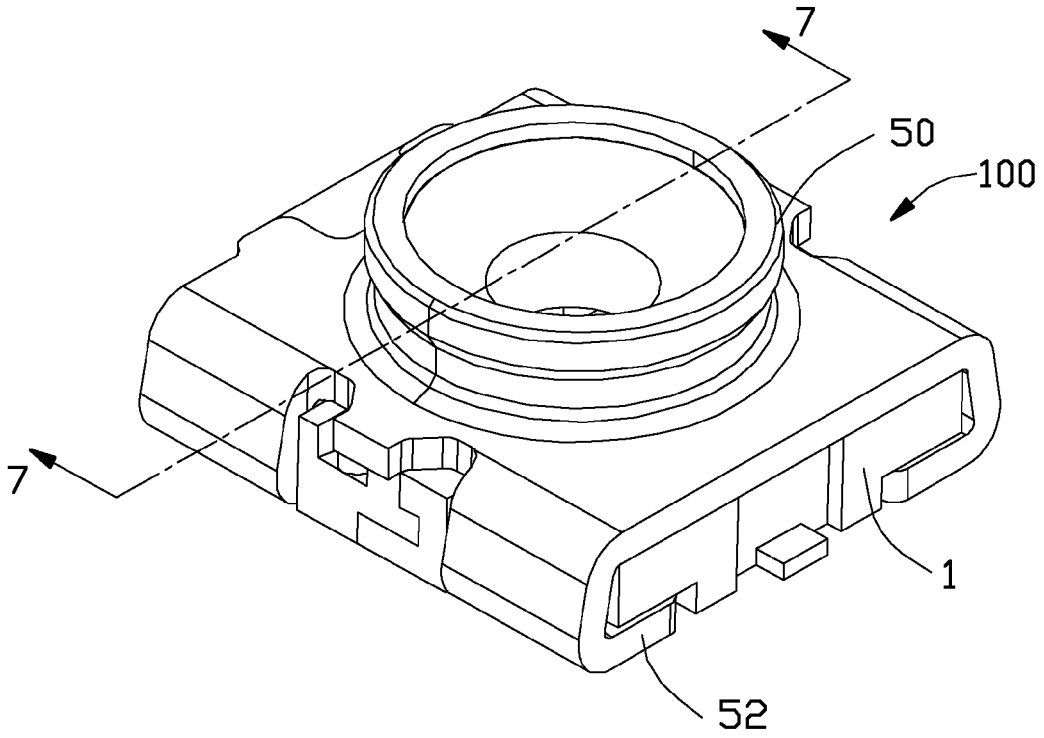
FIG. 1 is a perspective, assembled view of a coaxial RF connector of the present invention.
Figure 2:
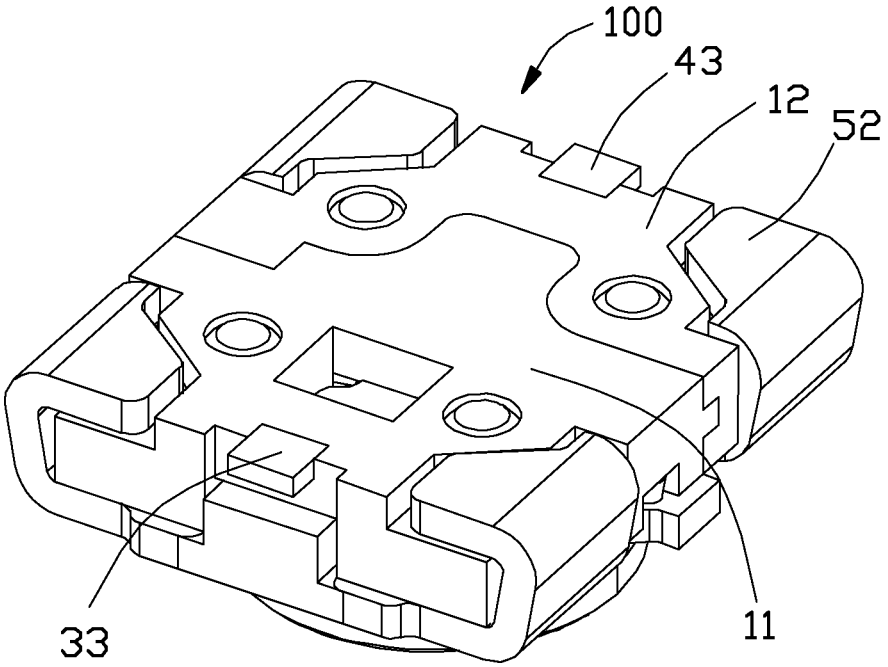
FIG. 2 is another perspective, assembled view similar to FIG. 1, taken from another aspect.
Figure 3:
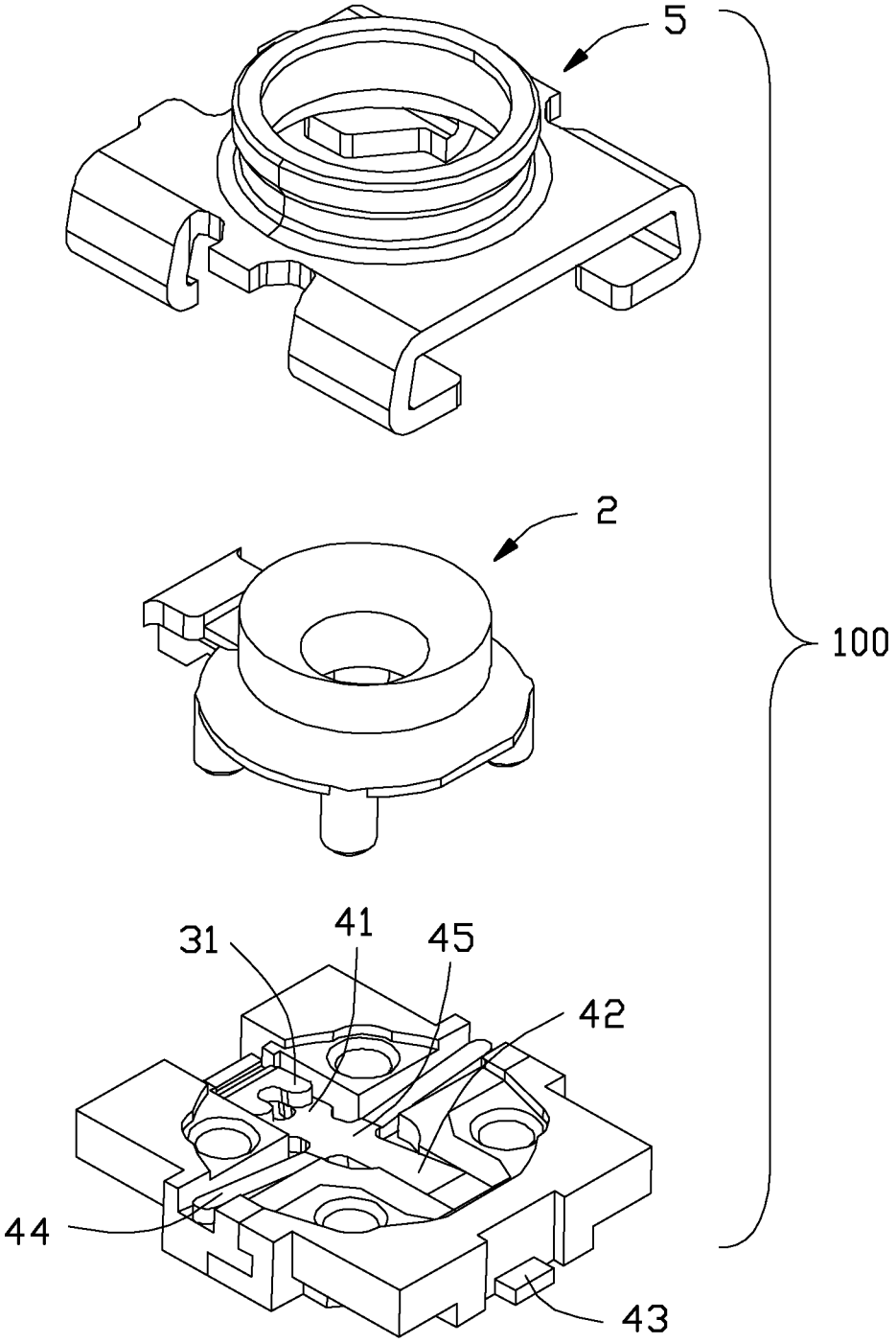
FIG. 3 is an exploded view of the RF connector.

Referring to FIGS. 1 to 3, a coaxial connector with RF characteristics (RF connector) 100 of the present invention, cooperated with the testing probe, comprises an insulative housing 1, an insulative cap 2 attached to the insulative housing 1, a static terminal 3 and a movable terminal 4 received between the insulative housing 1 and insulative cap 2, and a metal shell 5 covering the insulative housing 1 and the insulative cap 2.

Figure 4:
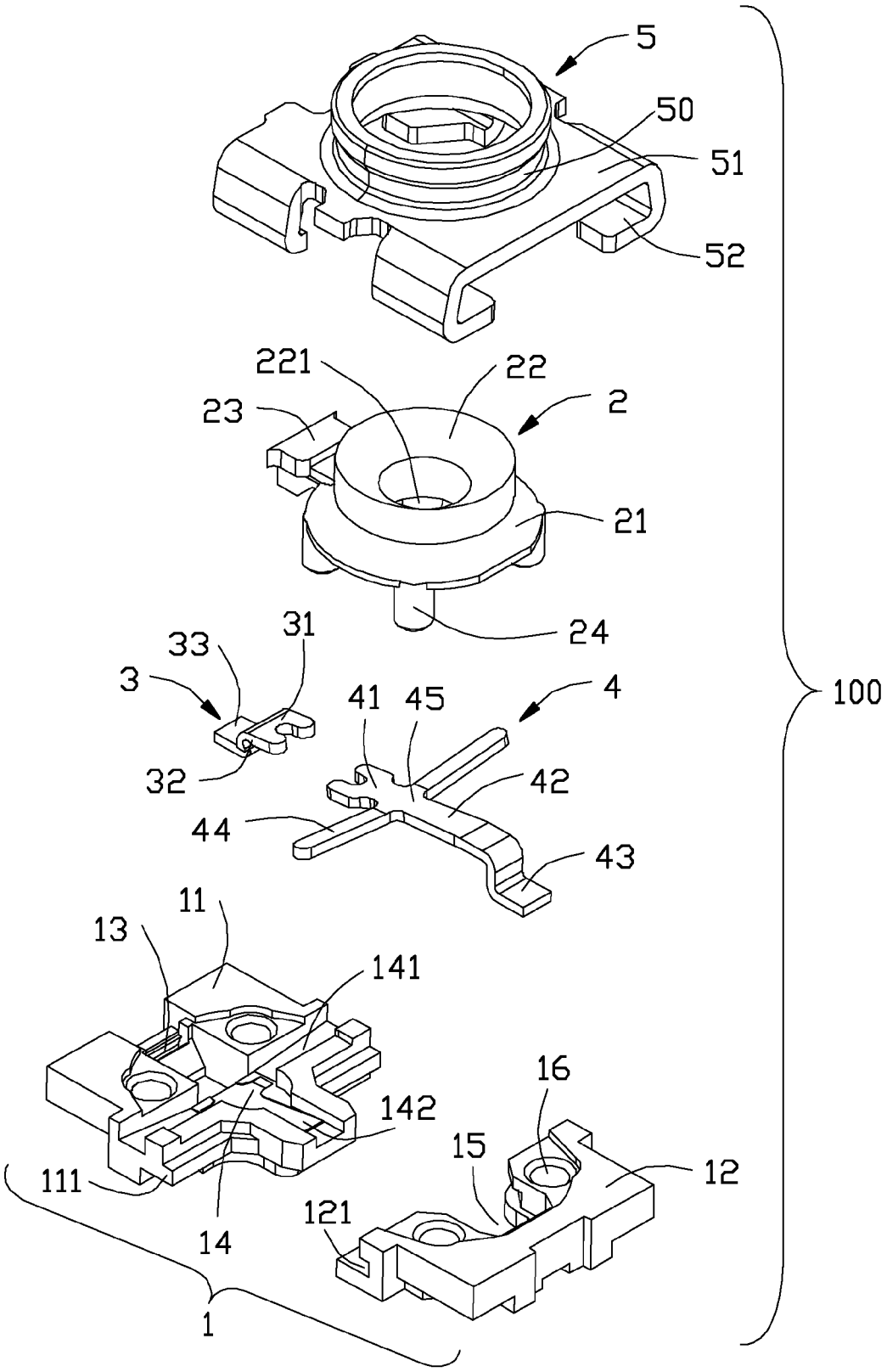
FIG. 4 is a further exploded view of the RF connector.
Figure 5:
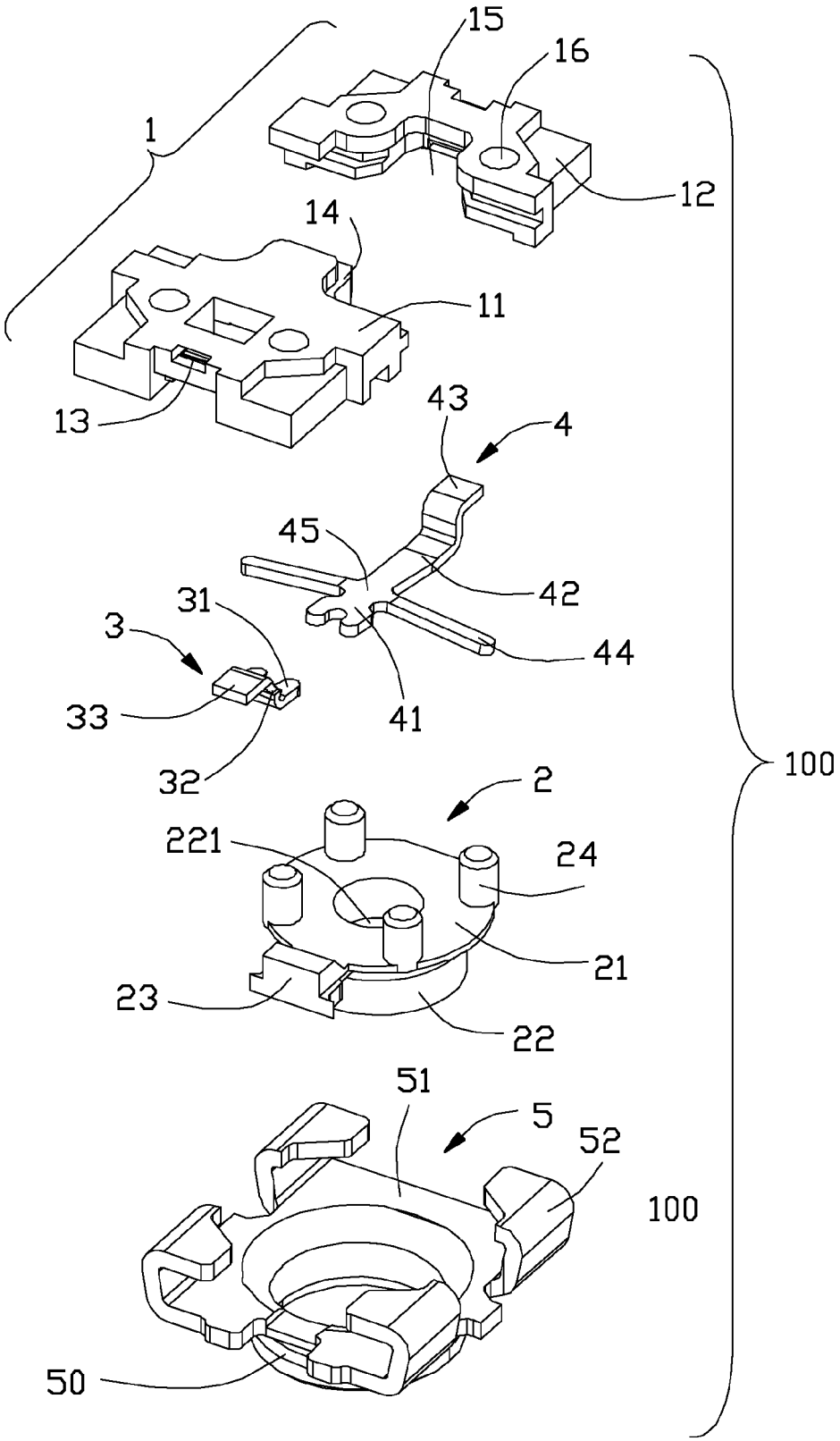
FIG. 5 is another exploded view similar to FIG. 4, taken from another aspect.

Referring to FIGS. 3-5, the insulative housing 1 includes a first insulative base 11 and a second insulative base 12. The static terminal 3 is insert molded with the first insulative base 11. The movable terminal 4 and the first insulative base 11 together are mounted to the second insulative base 12. The first insulative base 11 defines a first contact-receiving slot 13 receiving the static terminal 3 and a second contact-receiving slot 14 receiving the movable terminal 4. The second contact-receiving 14 slot includes an engaging groove 141 and a holding groove 142 crossing with the engaging groove 141. The engaging groove 141 defines a bottom wall 1411 inclining upwardly from a middle thereof to outer ends thereof.

The second insulative base 12 has a gap 15 cooperating with the holding groove 142. The first insulative base 11 and the second insulative base 12 have a pair of affixed holes 16 mated with the insulative cap 2. The insulative cap 2 attached at the insulative housing 1 includes a base body 21 and an attached portion 22 extending upwardly from a middle of the base body 21. A mating hole 221 through the middle of the attached portion 22 is provided for insertion of the testing probe. One side of the insulative cap 2 has a buckling portion 23 buckled with the insulative housing 1.

The bottom of the insulative cap 2 has a plurality of clipping portions 24 inserted into the mating holes 16 of the insulative housing 1.

The static terminal 3 stamped by metal sheet is ladder-shaped and comprises a first contacting portion 31, a first fixed portion 32 bent downwardly from one side of the first contacting portion 31 which is embedded in the first contact-receiving slot 13 of the insulative housing 1, and a first soldering portion 33 bent horizontally from one side of the first fixed portion 32. The first contacting portion 31 contacts with the movable terminal 4 electrically while the static terminal 3 is engaged in the first insulative base 11. The first soldering portion 33 extending from the insulative housing 1 is to solder with a printed circuit board.

Figure 8:
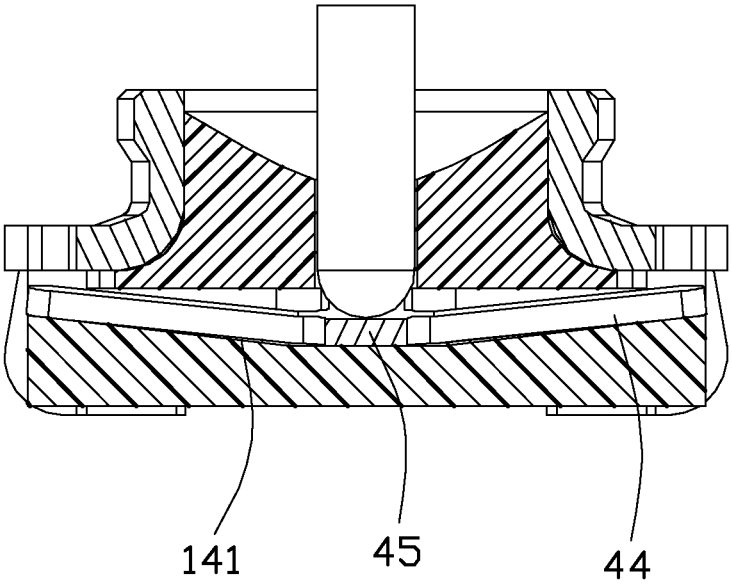
FIG. 8 is a cross-sectional view of the coaxial connector taken from line 7-7 in FIG. 1 when a testing probe is pressed.
Figure 9:
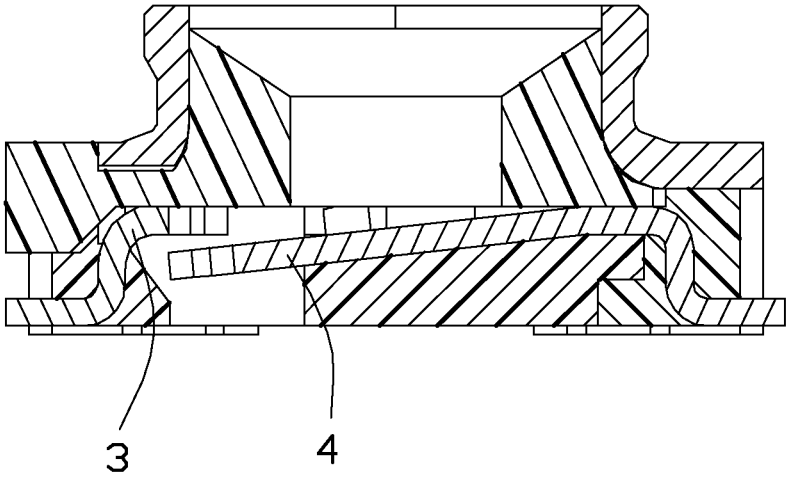
FIG. 9 is a cross-sectional view of the coaxial connector taken from line 9-9 in FIG. 1 when a testing probe is pressed.
Figure 10:
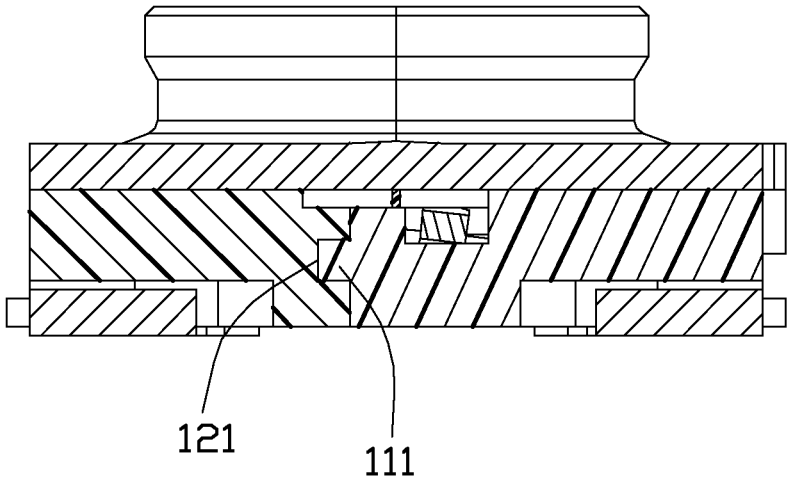
FIG. 10 is a cross-sectional view of the coaxial connector taken from line 10-10 in FIG. 1 to show engagement between the first insulative base and the second insulative base.

The movable terminal 4 includes a second contacting portion 41 contactable with the first contacting portion 31, a second fixed portion 42 extending from the second contacting portion 41, a resisting portion 45 connecting with the second contacting portion 41, and a pair of extension arms 44 extending from the resisting portion 45. The extension arms 44 shown in FIG. 3-5 are essentially in a pressed manner. In fact, the extension arms 44 should extend in a horizontal plane during relaxation as shown in FIG. 8.

The bottom wall 1411 inclining upwardly from a middle thereof to outer ends thereof supports the two free ends of the extension arms 44, and the resisting portion 45 is spaced from the bottom wall 1411 when the testing probe is not pressed on the resisting portion 45 but is in touch with the bottom wall 1411 when the testing probe is pressed on the resisting portion 45.

Figure 6:
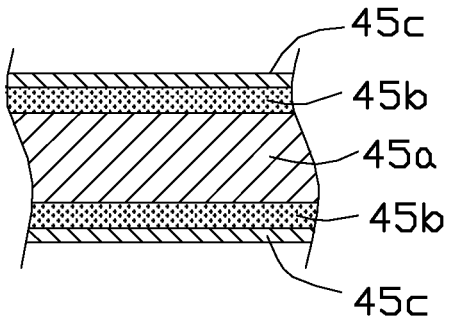
FIG. 6 is a cross-sectional view of the coaxial connector.
Figure 7:
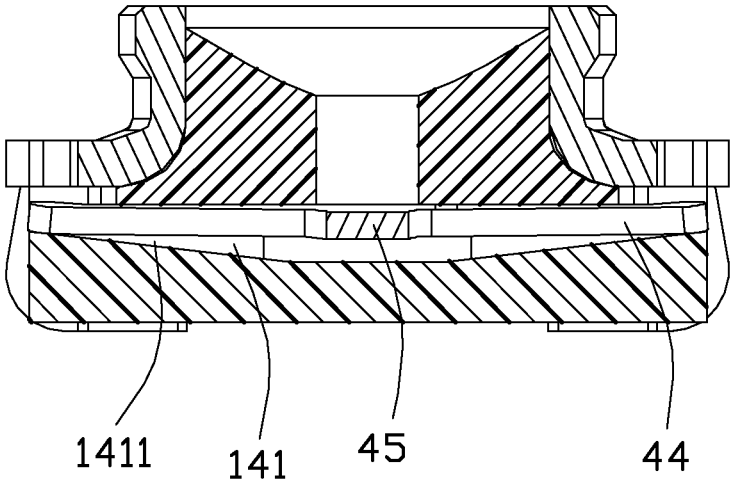
FIG. 7 is a cross-sectional view of the coaxial connector taken from line 7-7 in FIG. 1 when a testing probe is not pressed.

The movable terminal 4 is preferably formed by punching an SUS 301 stainless steel plate having a desired spring property as generally known in prior art. Namely, as shown in FIG. 6, the thickness of the stainless steel plate 45*a* is 60±3 μm, the nickel-plated layers 45*b* disposed on the upper and lower surfaces of the stainless steel plate 45*a* is between about 2.5 μm and about 5 μm, and the thickness of the gold-plated layers 45*c* is between 0.05 μm and about 0.10 μm.

The metal shell 5 includes a base body 51, a tubular portion 50 extending upwardly from the middle of the base body 51, and a pair of clasping arms 52 bent from the both sides of the base body 51 and extending downwardly. The tubular portion 50 receives the attached portion 22 of the insulative cap 2. The clasping arms 52 resist against the bottom of the insulative housing 1.

As is known in this art, the spring constant of the movable terminal 4 is supposedly fixed. Furthermore, the deterioration in the spring constant could not be recognized even on thousands of cycles of displacements of the movable terminal 4. The extension arms 44 extend from the resisting portion 45 and the resisting portion 45 is spaced from the bottom wall 1411 when the testing probe is not pressed on the resisting portion 45. The resisting portion 45 is in touch with the bottom wall 1411 when the testing probe is pressed on the resisting portion 45. When the testing probe is not attached to the attached portion 22, the movable terminal 4 abuts the static terminal 3 and the pushing load therebetween exceeds the stable pushing load that is required to maintain a stable contact connection. The extension arms 44 attached to the movable terminal 4 provide reliable forward force to make the resisting portion 45 to obtain stronger elastic force.

It is noted that the movable terminal 4 of the RF connector 100 has the extension arms 44 attached to the movable terminal 4, thus providing reliable forward force to achieve stronger elastic force for the resisting portion 45. The material of the movable terminal 4 of the RF connector is stainless steel plate. The convenient installing method contributes to cutting costs and saving time. In this embodiment, the moveable terminal 4 is integrally formed within the second insulative base 12 via an insert-molding process as second terminal module, and the static terminal 3 is integrally formed with the first insulative base 11 via another insert-molding process as a first terminal module. The first insulative base 11 forms an engagement rib 111 and the second insulative base 12 forms a groove 121 to receive the engagement rib 111. The first insulative base 11 and the second insulative base 12 are assembled together in the horizontal direction wherein the moveable terminal 4 is required to be upwardly deflected during such an assembling procedure until the engagement rib 111 is fully received within the groove 121 so as to resume to its relaxed state for being smoothly loaded into the engaging groove 141. Successively, the insulative cap 2 is assembled upon the assembled insulative housing 1 via the clipping portions 24 engaged within the mating holes 16, respectively, so as to assure the first insulative base 11 and the second insulative base 12 will not be separated from each other in the horizontal direction. Finally, the metal shell 5 is assembled upon the combined housing 1 and cap 2 by means of the clasping arms 52.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector comprising:

an insulative housing including a first insulative base and a second insulative base mounted to the first insulative base;

an insulative cap attached to the insulative housing;

a metal shell covering the insulative housing and the insulative cap;

a static terminal affixed to the insulative housing and having a first contacting portion; and a movable terminal of a cantilever structure supported by the first insulative base, the movable terminal including a second contacting portion contactable with the first contacting portion, a second fixed portion extending from the second contacting portion, a resisting portion connecting with the second contacting portion, and a pair of extension arms extending from the resisting portion; wherein the first insulative base defines a first contact-receiving slot receiving the static terminal and a second contact-receiving slot receiving the movable terminal, the second contact-receiving slot includes an engaging groove and a holding groove crossing with the engaging groove, the engaging groove defines a bottom wall inclining upwardly from a middle thereof to outer ends thereof to support the free ends of the extension arms, and the resisting portion is operable to be in touch with the bottom wall.

2. The electrical connector as claimed in claim 1, wherein said static terminal is insert molded with the first insulative base and said movable terminal is mounted to the first insulative base.

3. An electrical connector comprising:

an insulative housing including a first insulative base and a second insulative base, one of said first insulative base and said second insulative base forming a rib while the other forming a groove to receive said rib so as to have said first insulative base and said second insulative base assembled to each other in a first horizontal direction;

a receiving slot formed in the first insulative base;

a static terminal integrally formed within the first insulative base;

a moveable terminal integrally formed within the second insulative base;

an insulative cap mounted upon the insulative housing;

means for assembling the insulative cap to the housing in a vertical direction perpendicular to said first horizontal direction and retaining both said first insulative base and said second insulative base so as to prevent disassembling between the first insulative base and the second insulative base; wherein said moveable terminal is received within said receiving slot, and forms a pair of extension arms opposite to each other to provide supporting against downward movement of the moveable terminal.

4. The electrical connector as claimed in claim 3, further including metallic shell to enclose both the insulative cap and the insulative housing and assembled thereto by clasping arms in said vertical direction.

5. The electrical connector as claimed in claim 3, wherein a main body of the moveable terminal extends along said horizontal direction while the pair of extension arms extend along a second horizontal direction perpendicular to said first horizontal direction.

6. The electrical connector as claimed in claim 3, wherein said first insulative base is larger than said second insulative base in said first horizontal direction.

7. The electrical connector as claimed in claim 3, wherein the pair of extension arms commonly define a transverse dimension similar to that of the housing in the second horizontal direction.

8. The electrical connector as claimed in claim 3, wherein the receiving slot includes an engaging groove to receive said pair of extension arms.

9. The electrical connector as claimed in claim 8, wherein an inclined surface is formed on a bottom face of said engaging groove so as to have the extension arms deflected against said inclined surface.

10. The electrical connector as claimed in claim 8, wherein said engaging groove extends through the first insulative base in said second horizontal direction.

11. A method of making an electrical connector, comprising steps of:

providing a first terminal module with a static terminal integrally formed within a first insulative base, said insulative base forming a receiving slot;

providing a second terminal module with a moveable terminal integrally formed within a second insulative base;

providing means on both said first insulative base and said second insulative base for assembling said first insulative base and said second insulative base in a first horizontal direction;

assembling the first terminal module and the second terminal module in the first horizontal direction;

providing an insulative cap with means for assembling said cap to both said first insulative base and said second insulative base in a vertical direction perpendicular to said first horizontal direction;

assembling said cap upon the assemble first terminal module and second terminal module in the vertical direction; and providing said moveable terminal with a pair of extension arms extending opposite to each other in a second horizontal direction perpendicular to both said first horizontal direction and said vertical direction.

12. The method as claimed in claim 11, wherein said first insulative base further includes a receiving slot in which said moveable terminal is received.

13. The method as claimed in claim 12, wherein the receiving slot includes an engaging groove to receive said pair of extension arms.

14. The method as claimed in claim 13, wherein an inclined surface is formed on a bottom face in the engaging groove to have said extension arms deflected thereon.

15. The method as claimed in claim 13, wherein said engaging groove extends through said first insulative base in said second horizontal direction.

16. The method as claimed in claim 12, wherein said pair of extension arms commonly define a transverse dimension similar to that of the first insulative base in the second horizontal direction.

17. The method as claimed in claim 12, further including a step of assembling a metallic shell to the assembled cap and first insulative base and second insulative base in the vertical direction via clasping arms.

* * * * *